United States Patent [19]

Willis

[11] 4,016,452

[45] Apr. 5, 1977

[54] LAMP BALLAST CIRCUIT

[75] Inventor: Candler A. Willis, Zirconia, N.C.

[73] Assignee: General Electric Company, New York, N.Y.

[22] Filed: Jan. 14, 1975

[21] Appl. No.: 540,881

[52] U.S. Cl. ..... 315/278; 315/239; 315/240; 315/290; 315/DIG. 2; 315/DIG. 5

[51] Int. Cl.[2] ..... H05B 41/231

[58] Field of Search ..... 315/57, 70, 276, 283, 315/242, 244, DIG. 2, DIG. 5, DIG. 7, 278, 239, 240, 290

[56] References Cited

UNITED STATES PATENTS

| | | | |
|---|---|---|---|
| 2,858,478 | 10/1958 | Dershaw | 315/278 |
| 3,160,784 | 12/1964 | Strecker | 315/278 |
| 3,407,334 | 10/1968 | Attewell | 315/DIG. 5 |
| 3,611,026 | 10/1971 | Crawford | 315/276 X |
| 3,772,565 | 11/1973 | Lenz et al. | 315/276 |
| 3,778,677 | 12/1973 | Kriege | 315/DIG. 5 |
| 3,919,595 | 11/1975 | Willis, Jr. | 315/278 |

FOREIGN PATENTS OR APPLICATIONS

| | | | |
|---|---|---|---|
| 705,081 | 3/1954 | United Kingdom | 315/DIG. 5 |

*Primary Examiner*—Eugene La Roche
*Attorney, Agent, or Firm*—Sidney Greenberg

[57] ABSTRACT

Starting and operating ballast circuit for gaseous discharge lamp. Ballast winding comprises a pair of series connected coils each having a portion with a selected number of turns thereof connected in a high voltage starting circuit including a discharge capacitor and a voltage sensitive switch and forming a series discharge loop with the coil portions to provide high voltage, high frequency starting pulses on the lamp.

18 Claims, 3 Drawing Figures

LAMP BALLAST CIRCUIT

The present invention relates to discharge lamp operating and starting circuits, and particularly to such circuits for discharge lamps requiring a starting voltage substantially higher than the operating voltage.

It is an object of the invention to provide a simple, reliable and economical starting and operating circuit for gaseous discharge lamps which require high starting voltages.

It is a particular object of the invention to provide an improved circuit of the above type when used with a ballast transformer or reactor having a pair of series connected coils, and especially to provide improved voltage distribution in such coils.

Still another object of the invention is to provide a circuit of the above type wherein voltage stresses are reduced.

Other objects and advantages will become apparent from the following description and the appended claims.

With the above objects in view, the present invention in one of its aspects relates to a starting and operating circuit for gaseous discharge lamps comprising, in combination, a source of alternating current, ballasting means connected at its input side to the alternating current source, discharge lamp means connected to the output side of the ballasting means, the ballasting means comprising a pair of series connected coils, and high voltage starting means having a series discharge loop, including a predetermined number of turns of each of the coils for providing high voltage, high frequency starting pulses on the discharge lamp means.

The invention will be better understood from the following description taken in conjunction with the accompanying drawings, in which.

Figure 1:
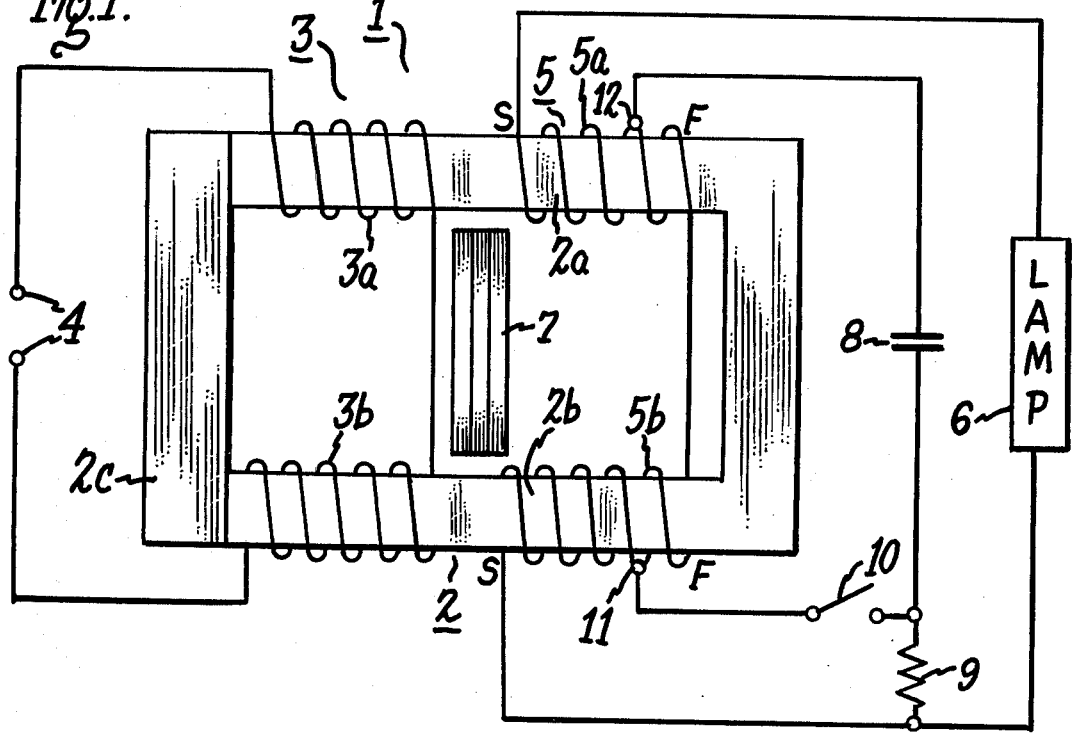
FIG. 1 is a schematic view of a ballast transformer in association with a circuit embodying the invention.

Referring now to the drawings, and particularly to FIG. 1, there is shown a ballast transformer 1 of isolation type comprising a closed magnetic core 2 of U-I type having spaced legs 2*a*, 2*b* and yoke member 2*c* defining a core window. Primary winding 3 of transformer 1 arranged at one end of core 2 comprises a coil winding 3*a* wound on leg 2*a* of core 2 in series with coil winding 3*b* on the opposite core leg 2*b*, and connected to terminals 4 of a source of alternating current. Secondary winding 5 of ballast transformer 1 comprises coil winding 5*a* arranged on core leg 2*a* in series with coil winding 5*b* wound on core leg 2*b*. Secondary winding 5 is connected in series with gaseous discharge lamp 6, such as a sodium vapor lamp or other gaseous discharge lamp which requires a high starting voltage. Ballast transformer 1 provides current limiting impedance for the proper operation of lamp 6, as well understood in the art.

Magnetic shunt 7 is arranged extending across the core window between primary winding 3 and secondary winding 5 for providing leakage reactance in transformer 1.

In order to produce high voltage, high frequency pulses, e.g., of 2 or 3 kilovolts for starting lamp 1, there is provided a high voltage ignition circuit comprising capacitor 8 and resistor 9 connected in series to one side of lamp 6, and switch 10 connected at one side to tap 11 on secondary core winding 5*b* and at the other side to the junction of capacitor 8 and resistor 9. Capacitor 8 in the illustrated embodiment is connected to tap 12 on secondary core winding 5*a*. Switch 10 may be any of various types of switches, and typically is a voltage sensitive symmetrical switch such as a neon glow lamp or a controlled semiconductor switch such as a triac triggered by suitable voltage sensitive triggering means.

In a circuit of this type wherein the turns of only one of the secondary coil windings are tapped off for connection in series with the capacitor and switch of the high voltage starting circuit, certain disadvantages are encountered, in that insufficient voltage is thereby induced in the other coil winding (i.e., the one not tapped), and the self-inductance of the latter coil winding would result in attenuation of the starting pulses, making it necessary to shunt the untapped coil winding by a high frequency by-pass capacitor.

This difficulty and other problems encountered in the aforesaid arrangement are avoided in accordance with the present invention by connecting capacitor 8 and switch 10 of the high voltage pulse generating circuit to taps on both coil windings 5*a*,5*b* of secondary winding 5, so that the tapped turns of both coil windings are included in the series discharge loop which includes capacitor 8 and switch 10, as shown in FIG. 1. Typically, the number of tapped turns in each coil winding is about the same.

The number of turns tapped off on the secondary coil windings should be sufficient to completely couple in an autotransformer action the high voltage across the entire secondary winding 5. The actual number of turns involved dictates the pulse inductance of the discharge loop. If the inductance is too small, the peak current in the discharge loop is too large, resulting in high resistance voltage drops around the loop and high switch losses, thus lowering the high voltage magnitude and energy level applied to lamp 6. In a typical arrangement in the embodiment illustrated, the ratio of total turns to tapped turns selected may be about 20:1, which usually suffices to provide good coupling and adequate peak output voltage for starting lamp 1.

Preferably, in accordance with the invention, the two secondary coil windings 5*a*,5*b* are connected finish-to-finish, as indicated in FIG. 1. There is thereby avoided excessive voltage between the outer layers of each coil. This type of connection not only provides for less voltage stress, but also, because the finish layer of turns in on the outside of the coil, enables ready access to an appropriate number of coil turns for tapping, and provides better high frequency coupling between the tapped turns and the total coil turns. However, the invention is not limited to such a connection, and a start-to-start connection may be used where appropriate and where the foregoing considerations are not critical.

As well understood in the art and as used herein, the expression "connected finish-to-finish" means that the finish ends of the respective coil windings are connected together, it being understood that the finish ends are at the outer layer of turns on the wound coil. The start (or starting) ends of the coils are, of course, at the innermost layer of turns of the coils.

In the operation of the described circuit, capacitor 8 is initially charged through resistor 9 by the secondary voltage induced in secondary winding 5 by primary winding 3 connected to the alternating current source. As the voltage across capacitor 8 rises, it reaches the breakdown potential of voltage sensitive switch 10. When this occurs, capacitor 8 discharges through the tapped turns of secondary winding 5, i.e., the turns between taps 11 and 12, placing, say, 200 volts across those turns, resulting in a step-up secondary winding 5 acting as a pulse transformer to a voltage of, say, about 3000 volts which appears across the total turns of secondary winding 5. High frequency pulses of this high voltage level are thereby produced across lamp 6 by the pulse generating circuit described. Typically, the pulses have a discharge frequency of about 250 kilocycles, although the frequency may be in the range of about 100 to 1000 kilocycles. Upon the starting of lamp 6, the pulse mechanism is disabled as a result of the voltage clamping action of the ignited lamp load, and therefore the voltage buildup across capacitor 8 does not reach the breakdown level of voltage sensitive switch 10. The described circuit has the added advantage that the portion of coil winding 5*a* between the starting end S and tap 12 is not loaded by the RC network constituted by capacitor 8 and resistor 9, thereby contributing to higher pulse voltages.

In an embodiment in which a triac or other controlled semiconductor switch is employed as switch 10, a known type of triggering device may be used for triggering the operation of the triac, such as shown in copending application Ser. No. 500,631 filed Aug. 26, 1974, now U.S. Pat. No. 3,917,976 issued Nov. 4, 1975 and assigned to the same assignee as the present invention, and the disclosure therein relating to such triggering device is accordingly incorporated herein by reference.

Figure 2:
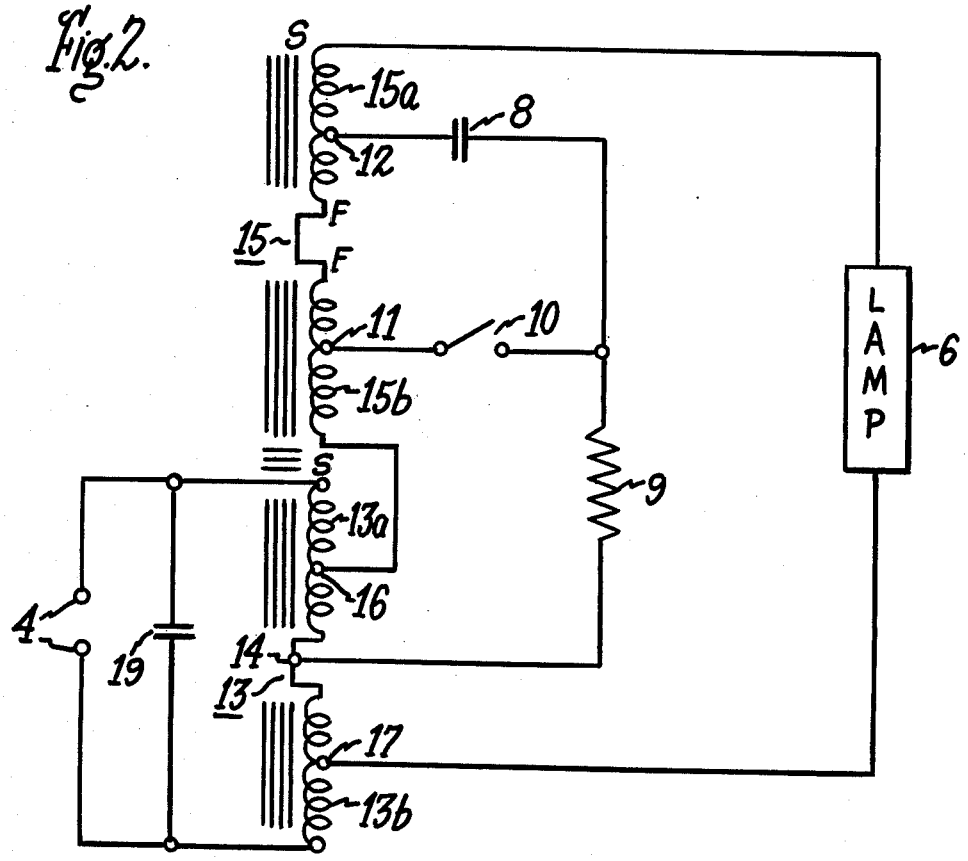
FIG. 2 is a circuit diagram of another embodiment of the invention.

FIG. 2 shows another embodiment of the invention, wherein the ballasting means is a so-called lag ballast incorporating a high reactance autotransformer. The ballast, which also may comprise a U-I type core such as shown in FIG. 1, comprises primary winding 13 connected to alternating current source terminals 4 and having two series connected coil windings 13*a*,13*b* and secondary winding 15 having two series connected coil windings 15*a*,15*b*. At one side secondary winding 15 is connected to tap 16 on primary coil winding 13*a* and at its other side is connected to gaseous discharge lamp 6, which is connected at its other side to tap 17 on primary winding coil 13*b*. The portions of the respective primary winding coils between the supply lines and taps 16 and 17 thus provide for a common voltage which is additive to the voltage of the secondary winding. It will be understood, however, that the connections represented by taps 16 and 17 may be at different places on the primary winding coils, or even at the supply lines, depending on the source voltage and the desired voltage to be supplied to lamp 6.

Similarly to the arrangement shown in FIG. 1, capacitor 8 and switch 10 are connected to taps 11 and 12 on the respective secondary coil windings 15*a*,15*b* to form a high voltage starting circuit as described above, with resistor 9 being connected at one side in series with capacitor 8 and at its other side to terminal 14 at the junction of the two primary coil windings. The latter connection provides for obtaining a greater voltage for charging capacitor 8 as compared to the connection of resistor 9 to the secondary winding as in the FIG. 1 circuit. As in the FIG. 1 embodiment, secondary winding coils 15*a*,15*b* are preferably connected finish-to-finish as indicated in FIG. 2.

The voltage between terminals 11 and 14 of the starting circuit is high enough under open circuit conditions to ignite lamp 6, while under operating conditions this voltage drops to a level at which the starting circuit is disabled.

Capacitor 19 serving as a power factor correction capacitor, may be connected as shown across primary winding 13, when provision of such a capacitor is necessary or desirable.

Figure 3:
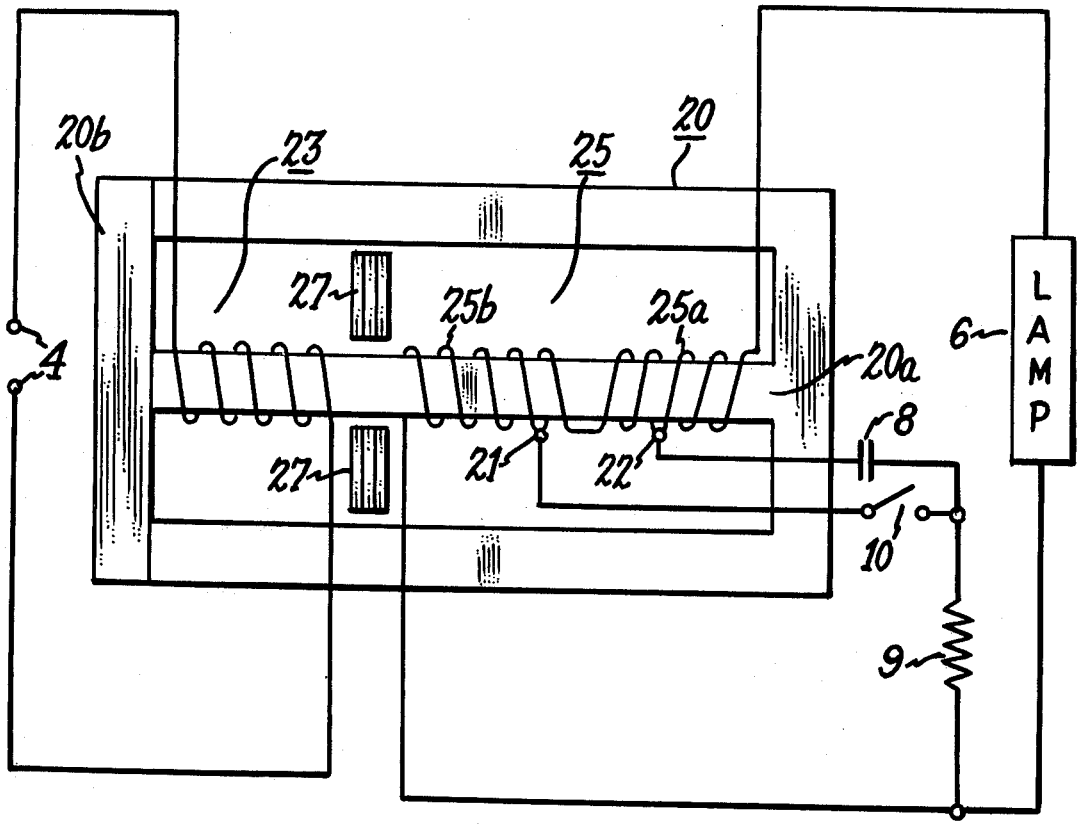
FIG. 3 is a schematic view of a different form of ballast transformer with which the circuit of the invention may be employed.

FIG. 3 shows another embodiment of the invention wherein a ballast transformer having a magnetic core 20 of E-I type is employed. In this embodiment, primary winding 23 and the series connected secondary winding coils 25*a*,25*b* are wound on central leg 20*a* of the core on opposite sides of magnetic shunts 27 arranged in the two windows of the core as shown. The high voltage pulse generating circuit comprising capacitor 8 and switch 10 is connected to taps 21 and 22 on the respective secondary coils so as to form a series discharge circuit including the tapped turns of the secondary coils, substantially as described in connection with the previously disclosed embodiments.

The circuit arrangement thus provided in accordance with the invention in effect makes a high frequency stepup autotransformer from two coils which, although they are magnetically coupled at power frequency, e.g., 60 Hz., are either non-coupled or poorly coupled at high starting pulse frequencies. A number of advantages are thereby afforded. By virtue of the tapping of both secondary coils as described, the volts per turn required to produce a given starting voltage is reduced by half, thereby reducing insulation voltage stress or permitting higher voltage starting pulses. Also, the described arrangement facilitates generation of higher voltages by using a high turns ratio without encountering the difficulties associated with the use of very few turns in the tapped coil sections, such as low pulse inductance and poor coupling between the tapped section and the total coil winding. As will be understood, the pulse inductance, in combination with the charging capacitor, determines pulse width, hence it is desirable to maintain a high level of pulse inductance so as to provide adequate pulse duration to ensure starting of the lamp.

Although the invention has been described in connection with particular forms of ballast transformers, it may be used in conjunction with other types of ballast inductors such as reactors.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A starting and operating circuit for gaseous discharge lamps comprising, in combination, a source of alternating current, ballasting means connected at its input side to said alternating current source, discharge lamp means connected to the output side of said ballasting means, said ballasting means comprising a pair of series connected coils each having a plurality of turns, and high voltage starting means having a series discharge loop including a predetermined number of turns of each of said coils for providing high voltage, high frequency starting pulses on said discharge lamp means.

2. A circuit as defined in claim 1, said ballasting means comprising an isolation transformer having a primary winding connected across said alternating current source, and having a secondary winding comprising said pair of coils.

3. A circuit as defined in claim 1, said high voltage starting means comprising a charging capacitor and a resistor connected in series to said discharge lamp means, and voltage sensitive switch means having a predetermined breakdown voltage connected across said charging capacitance and said predetermined number of turns of said coils and forming therewith said series discharge loop.

4. A circuit as defined in claim 1, said predetermined number of turns of each of said coils being substantially equal.

5. A circuit as defined in claim 1, said ballasting means comprising a closed magnetic core having spaced core legs, said pair of coils being arranged on different ones of said core legs.

6. A circuit as defined in claim 1, said pair of coils being connected finish-to-finish.

7. A circuit as defined in claim 1, said ballasting means comprising a ballast transformer having a primary winding connected to said alternating current source, and having a secondary winding comprising said pair of series connected coils, said coils being substantially spaced apart from one another.

8. A circuit as defined in claim 7, said high voltage starting means comprising a charging capacitor and a resistor connected in series to said discharge lamp means, and voltage sensitive switch means having a predetermined breakdown voltage connected across said charging capacitor and said predetermined number of said turns of said coils and forming therewith said series discharge loop.

9. A circuit as defined in claim 1, said ballasting means comprising a ballast transformer comprising a magnetic core having a plurality of spaced legs, said ballast transformer having a primary winding arranged on one of said legs and having a secondary winding comprising said pair of coils arranged on said one leg.

10. A circuit as defined in claim 9, said magnetic core being of E-I type having a central leg, said primary winding and said secondary winding being arranged on said central leg.

11. A circuit as defined in claim 1, said ballasting means comprising an autotransformer having a primary winding connected across said alternating current source, and having a secondary winding comprising said pair of coils.

12. A circuit as defined in claim 11, said high voltage starting means comprising a charging capacitor and a resistor connected in series to said discharge lamp means, and voltage sensitive switch means having a predetermined breakdown voltage connected across said charging capacitor and said predetermined number of said turns of said coils and forming therewith said series discharge loop.

13. A circuit as defined in claim 12, said resistor being connected to said primary winding.

14. A circuit as defined in claim 1, said ballasting means comprising a ballast transformer having a closed magnetic core having spaced core legs, magnetic shunt means arranged between said core legs, said ballast transformer having a primary winding comprising a pair of winding portions and having a secondary winding comprising said pair of coils, said primary winding and said secondary winding being arranged on opposite sides of said magnetic shunt means.

15. A circuit as defined in claim 14, said pair of primary winding portions being arranged on different ones of said spaced core legs and said pair of secondary coils being arranged on different ones of said spaced core legs.

16. A circuit as defined in claim 15, said secondary coils being connected finish-to-finish.

17. A circuit as defined in claim 16, said high voltage starting means comprising a charging capacitor and a resistor connected in series to said discharge lamp means, and voltage sensitive switch means having a predetermined breakdown voltage connected across said charging capacitor and said predetermined number of said turns of said coils and forming therewith said series discharge loop.

18. A circuit as defined in claim 17, said predetermined number of turns of each of said coils being substantially equal.

* * * * *